US007918232B2

(12) United States Patent
Karles et al.

(10) Patent No.: US 7,918,232 B2
(45) Date of Patent: Apr. 5, 2011

(54) ON LINE FORMATION OF RECESSED CIGARETTE FILTER

(75) Inventors: Georgios D. Karles, Richmond, VA (US); Henry M. Dante, Midlothian, VA (US); Xuan M. Pham, Glen Allen, VA (US); Barry S. Smith, Hopewell, VA (US)

(73) Assignee: Philip Morris USA Inc., Richmond, VA (US)

( * ) Notice: Subject to any disclaimer, the term of this patent is extended or adjusted under 35 U.S.C. 154(b) by 683 days.

(21) Appl. No.: 11/643,155

(22) Filed: Dec. 21, 2006

(65) Prior Publication Data

US 2007/0102012 A1 May 10, 2007

Related U.S. Application Data

(62) Division of application No. 10/410,626, filed on Apr. 9, 2003, now abandoned.

(51) Int. Cl.
*A24D 3/04* (2006.01)

(52) U.S. Cl. ..... 131/342; 131/344; 131/345

(58) Field of Classification Search ..... None
See application file for complete search history.

(56) References Cited

U.S. PATENT DOCUMENTS

| | | | | | |
|---|---|---|---|---|---|
| 1,993,728 | A | * | 3/1935 | Aivaz | 493/50 |
| 2,576,047 | A | * | 11/1951 | Schaffert | 430/125.5 |
| 2,881,770 | A | | 4/1959 | Touey et al. | |
| 2,928,400 | A | | 3/1960 | Touey | |
| 3,236,244 | A | * | 2/1966 | Irby, Jr. et al. | 131/274 |
| 3,339,560 | A | | 9/1967 | Kiefer et al. | |
| 3,658,069 | A | * | 4/1972 | Wise et al. | 131/342 |
| 5,012,828 | A | | 5/1991 | Hayes et al. | |
| 5,031,646 | A | * | 7/1991 | Lippiello et al. | 131/352 |
| 5,144,964 | A | * | 9/1992 | Demain | 131/275 |
| 5,322,495 | A | | 6/1994 | Budjinski, II et al. | |
| 5,404,890 | A | * | 4/1995 | Gentry et al. | 131/342 |
| 5,465,739 | A | * | 11/1995 | Perfetti et al. | 131/335 |
| 5,590,449 | A | | 1/1997 | Chehab et al. | |
| 5,662,126 | A | | 9/1997 | Charlton et al. | |
| 5,875,824 | A | * | 3/1999 | Atwell et al. | 141/67 |

FOREIGN PATENT DOCUMENTS

GB 1045826 10/1966

* cited by examiner

*Primary Examiner* — Richard Crispino
*Assistant Examiner* — Michael J Felton
(74) *Attorney, Agent, or Firm* — Connolly Bove Lodge & Hutz LLP

(57) ABSTRACT

A process for the on line production of cigarette filters comprises the steps of conveying a continuous thin flexible substrate past a source of smoke altering particulate material, such as adsorbents, catalysts and flavorants. An electrostatic charge is applied onto the substrate upstream of the source of particulate material. A layer of particulate material from the source is deposited onto the substrate with the thickness of the layer depending upon the strength of the electrostatic charge. The coated substrate is then cut into pieces, and the pieces are placed into the cavities between spaced apart filter components. In an alternative process, filter paper is coated with smoke altering particulate material by electrostatic deposition techniques, and spaced apart filter components are placed onto the particulate coated filter paper which is then folded around the filter components.

23 Claims, 2 Drawing Sheets

Fig. 1.
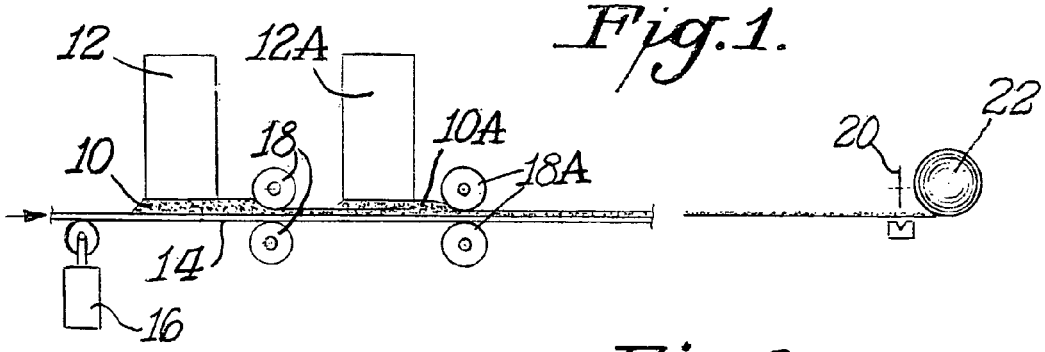
Fig. 3.
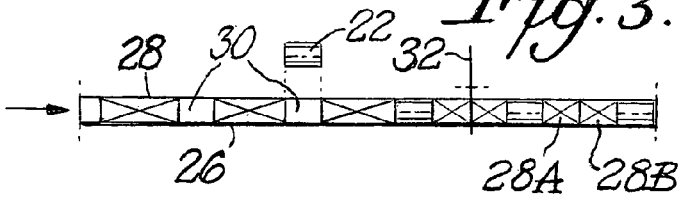
Fig. 2.
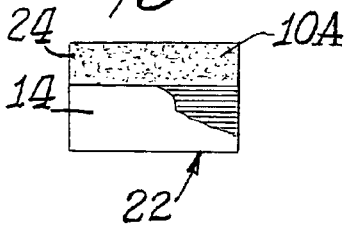
Fig. 4.
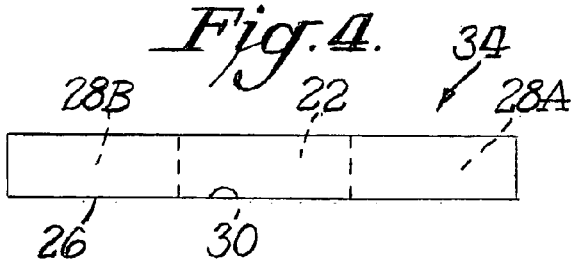
Fig. 5.
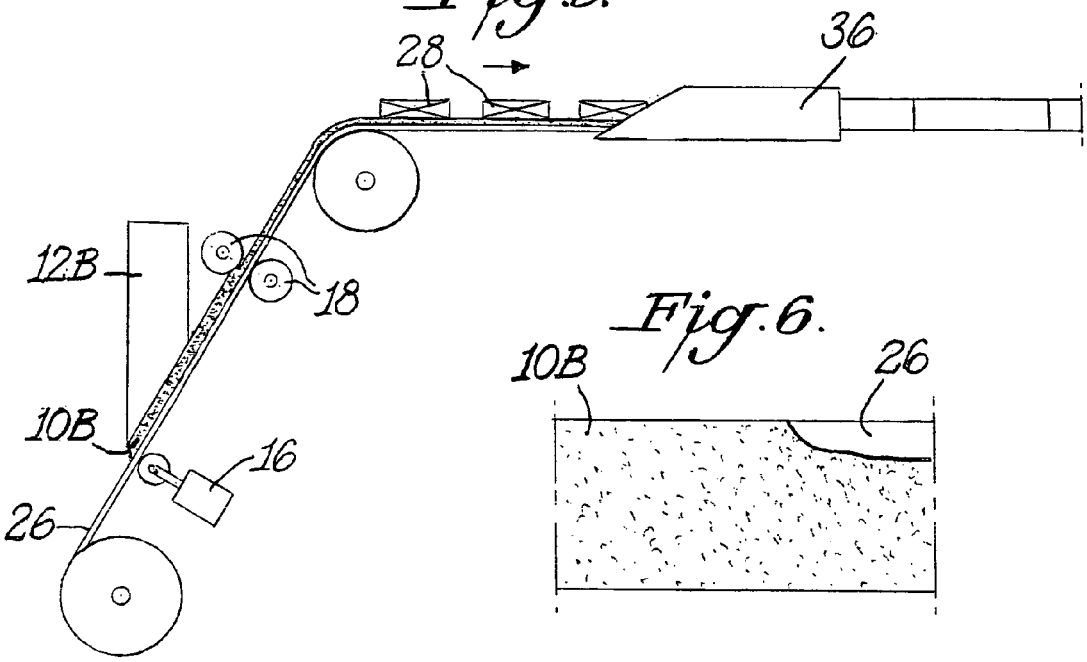
Fig. 6.

ON LINE FORMATION OF RECESSED CIGARETTE FILTER

CROSS-REFERENCE TO RELATED APPLICATION

The present application is a division of application Ser. No. 10/410,626, filed Apr. 9, 2003.

BACKGROUND OF THE INVENTION

The present invention relates to the formation of recessed cigarette filters, and more particularly to the on line formation of filters that include smoke altering particulate material such as catalysts, adsorbents, flavors and the like.

Many filter making procedures include combining a number of independent filter components fabricated beforehand, stored and then combined into a particular cigarette filter design, such as a plug-space-plug configuration. Such procedures require a number of steps which can be eliminated with on line formation of the filter components, such as the step of storing the preformed filter components before assembly.

SUMMARY OF THE INVENTION

Accordingly, one of the objects of the present invention is a procedure for the on line formation of cigarette filters in the production of cigarettes.

Another object of the present invention is a procedure for on line formation of filters which enables variation of the process parameters to produce filters of different construction and efficiency.

Still another object of the present invention is a filter making process which is simple, but highly effective in producing cigarette filters at high production speeds.

In accordance with the present invention, an electrostatic deposition or other process such as xerography or electrophotography that allows the formation of a layer of smoke altering particulate material on a paper substrate or the filter paper or any other suitable substrate is used on line to create an active layer in the recessed area of a cigarette filter. The amount of smoke altering particulate material can be varied depending on the strength of the applied field and coverage on the filter paper. The particulate material may be bound together using small amounts of a hot melt binder. Hot melt binders are preferred over solution or latex binders which may require extensive drying for the removal of the liquid carrier. Moreover, the use of such a binder to keep the particulate material bound to the surface of the paper does not render the material inactive. A wide variety of particulates may be deposited in this manner such as catalysts, flavors and adsorbents, for example.

Particulate material may be introduced in the electrostatically deposited layer to assist in the removal of specific components in the tobacco smoke stream. Silicas could be used to remove specific aldehydes, for example.

The electrostatically deposited layer could also include a combination of particulates such as a carbon adsorbent and a flavorant that enhances the flavor or subjective characteristics of the cigarette. This along with the ability to apply the layer on line improves the flexibility of the cigarette designer in terms of smoke delivery and increases the ability to control the quality of the entire process.

Another aspect of the invention deals with the use of nonwovens in place of particulate laden paper. For example, a nonwoven activated carbon piece may be used in place of carbon filled paper. Under some circumstances cellulose fibers used in the carbon filled paper are hygroreactive and may tend to make the smoke dry. Accordingly, use of a paperless nonwoven with activated carbon adsorbent could improve the subjective characteristics experienced during the smoking process.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which:

FIG. 1 is a schematic diagrammatic view illustrating on line electrostatic deposition of particulate material onto a substrate and formation of the particulate coated substrate into plug form for on line insertion into the cavities between a continuous line of spaced apart cellulose acetate plugs;

FIG. 2 is a side elevational view of the particulate plug of FIG. 1 after being cut and prior to the flap being folded over to complete the plug form;

FIG. 3 is a schematic diagrammatic view illustrating the plugs of FIG. 1 inserted into the cavities between spaced apart cellulose acetate plugs in the continuous production of cigarette filters;

FIG. 4 is a complete plug-space-plug cigarette filter with a particulate plug in the cavity between two cellulose acetate plugs;

FIG. 5 is a schematic diagrammatic view illustrating an alternate process for on line electrostatic deposition of particulate material onto filter paper during the continuous production of plug-space-plug cigarette filters;

FIG. 6 is a plan view of the cigarette filter paper of FIG. 5 with smoke altering material electrostatically deposited on the paper;

DETAILED DESCRIPTION OF THE INVENTION

Figure 7:
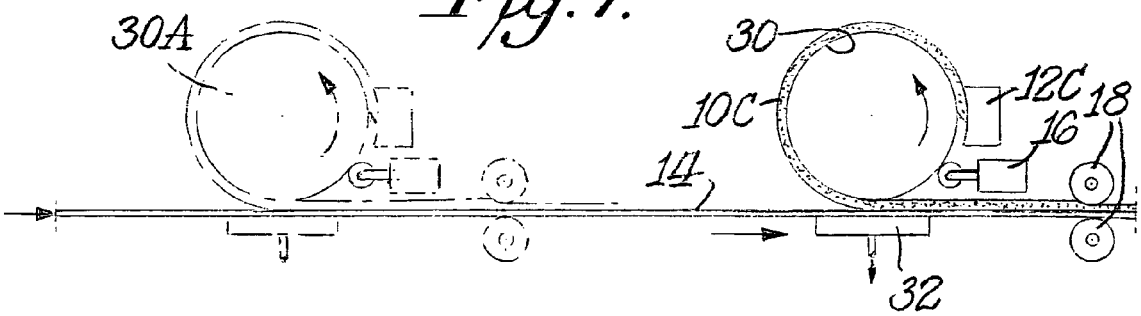
FIG. 7 is a schematic diagrammatic view illustrating still another procedure for on line electrostatic deposition of particulate material onto filter paper by indirect transfer.

Referring in more particularity to the drawings, FIG. 1 illustrates an arrangement for depositing particulate material 10 from a first supply 12 onto a continuous thin flexible substrate 14. The substrate may be paper or nonwoven material, for example, and the particulate material 10 may comprise any smoke altering particles such as adsorbents, catalysts and flavorants. Adsorbents may include carbon, zeolite, APS silica gel and other adsorbent materials alone or in combination with one another. For example, silica is particularly effective for removing specific aldehydes from tobacco smoke.

An electrostatic charge is applied onto the substrate 14 by any suitable mechanism such as the corona discharge device 16 shown in FIG. 1. The strength of the charge is selected in accordance with the thickness of particulate material coated onto the substrate 14 with higher charges producing greater thickness. As the electrostatically charged substrate 14 travels in a downstream direction past the first supply 12 of particulate material 10, the substrate becomes coated with the material. The particles may be bound together using small amounts of hot melt binder, if desired. Moreover, the coated substrate may pass through the nip of a pair of rollers 18 to fuse or otherwise press the particulate material 10 into the substrate 14, as shown in FIG. 1.

The particulate material may be deposited in a single pass or multiple layers may be applied to the substrate. In this regard, a second supply 12A of the same or different particulate 10A deposits another layer on the first deposited layer, and rollers 18A press the material onto the substrate.

The particulate coated substrate 14 is then cut into pieces by cutter 20 and those pieces are deposited into cavities between spaced apart filter components, as explained more fully below.

In a preferred embodiment of the present invention the cut pieces are formed into a cylindrical plug 22 by rolling the coated substrate piece into that configuration. FIGS. 1 and 2 illustrate the plug 22, and in FIG. 2 flap 24 is ready for folding over to complete the plug form.

FIG. 3 illustrates an arrangement for producing a continuous line of plug-space-plug filters. This arrangement includes filter paper 26 with spaced apart plugs 28 of cellulose acetate on the filter paper. Cavities 30 are located between the cellulose acetate plugs, and the plug rolls 22 of particulate coated substrate are deposited into these cavities. Ultimately, the continuous filter of FIG. 3 is cut at 32 into the plug-space-plug filter 34 shown as in FIG. 4. The spaced apart cellulose acetate plugs 28 A and B define the cavity 30 into which the plug roll 22 has been deposited. The filter paper 26 surrounds this assembly.

FIG. 5 illustrates an alternative embodiment of the present invention where the filter paper 26 is coated with particulate material 10B from a source 12B. Here again an electrostatic charge is applied to the filter paper 26 with charger device 16. The filter paper 30 with particulate thereon passes through the rollers 18 and thereafter cellulose acetate plugs 28 are appropriately positioned on the coated filter paper. The coated filter paper is ultimately wrapped around the spaced apart cellulose acetate plugs 28 with plows 36 and the continuous filter arrangement is later cut into individual cigarette filter assemblies, such as shown in FIG. 4. However, in this particular embodiment the cavities are somewhat hollow and the smoke altering particulate material 10 is in the form of an inside surface layer within the cavity 30. FIG. 6 shows the filter paper 26 coated with the particulate material 10B.

FIG. 7 illustrates another embodiment of the present invention where the continuous thin flexible substrate 14 is indirectly coated with particulate material 10C. A rotating transfer roll 30 receives an electrostatic charge from device 16, and particulate material 10C is deposited on the charged surface of the roll from a supply 12C. The particulate material on the surface of the roll is transferred onto substrate 14 by suction, from a plenum 32, for example. Thereafter, the layer of material 10C passes through the nip of rollers 18 to fuse or otherwise press the material into the substrate. The coated substrate is subsequently cut and formed into filter pieces, as described above.

FIG. 7 also illustrates an optional second transfer station 30A for depositing another layer on the substrate similar to the system described above in conjunction with FIG. 1.

Figure 8:
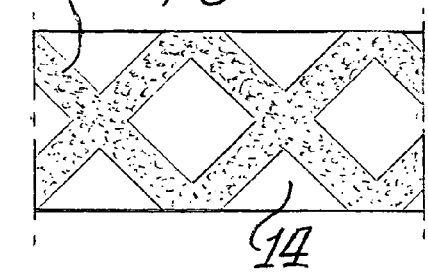
FIG. 8 shows particulate material electrostatically deposited on the paper in pattern form.

The layer of particulate material 10D of FIG. 8 is deposited on substrate 14 in pattern form. In this regard, the charging device may be constructed and arranged to place a pattered charge on the substrate, and the particulate only adheres to the substrate at the charged portions thereof.

Figure 9:
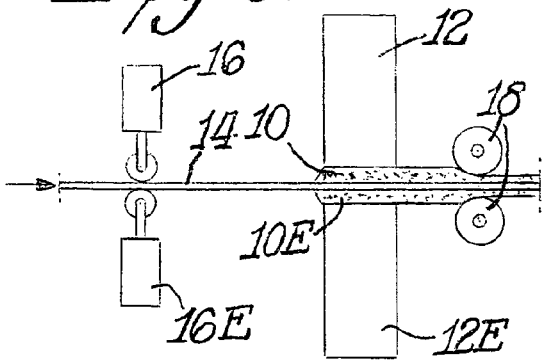
FIG. 9 is another schematic diagrammatic view showing particulate material deposited on both sides of a suitable substrate.

FIG. 9 shows an arrangement for applying particulate material layers 10 and 10E on opposite sides of substrate 14. A first supply 12 of particulate material is located on one side of the substrate and a second supply 12E is located on the other side of the substrate. An electrostatic charge is applied to both sides of substrate 14 by devices 16 and 16E. Otherwise the system is similar to FIG. 1, and the coated substrate is formed into filter components in the same manner as described above.

Figure 10:
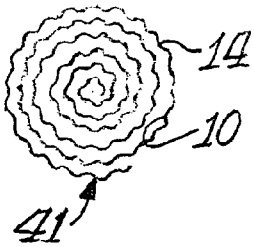
FIG. 10 is an end elevated view of a roll formed filter component where the particulate coated substrate is crimped before being rolled.

FIG. 10 is cross-sectional view of a filter component 40 similar to the one shown in FIG. 2. However, in filter component 40 the substrate 14 coated with particulate material is crimped prior to being roll formed into its final configuration.

It should be understood that the above detailed description while indicating preferred embodiments of the invention are given by way of illustration only since various changes and modifications within the spirit and scope of the invention will become apparent to those skilled in the art from the detailed description. For example, different particulate materials may be combined in single and multiple layers.

We claim:

1. A process for producing cigarette filters comprising the steps of:

a) conveying a continuous thin flexible filter paper substrate past a source of smoke altering particulate material;

b) applying an electrostatic charge onto the substrate upstream of the source of particulate material;

c) depositing a layer of particulate material from the source onto the substrate;

d) fusing or pressing the particulate material onto the substrate;

e) rolling the particulate coated substrate into a cylindrical form along an axis transverse to the direction of substrate conveyance, wherein the rolling occurs prior to the steps of cutting the particulate coated substrate into pieces and placement of the pieces into a position between spaced apart filter components;

f) cutting the particulate coated substrate into pieces; and g) placing the pieces into cavities between spaced apart filter components.

2. A process as in claim 1 wherein the particulate material is selected from the group consisting of adsorbents, catalysts and flavorants.

3. A process as in claim 1 wherein the particulate material is an adsorbent selected from the group consisting of carbon, zeolite and APS silica gel.

4. A process as in claim 1 wherein the step of applying the electrostatic charge is variable whereby the thickness of the layer of particulate material is variable depending upon the strength of the electrostatic charge on the substrate.

5. A process as in claim 1 including the step of adding flavor to the particulate material.

6. A process as in claim 1 wherein the layer comprises multiple layers of particulate material, whereby steps c) and d), and optionally step b), are repeated to create the multiple layers.

7. A process as in claim 6 wherein the multiple layers of particulate material are on opposite sides of the substrate.

8. A process for producing cigarette filters comprising the steps of:

a) conveying a continuous thin flexible filter paper substrate past a source of smoke altering particulate material;

b) applying an electrostatic charge onto the substrate upstream of the source of particulate material;

c) depositing a layer of particulate material from the source onto the substrate;

d) fusing or pressing the particulate material onto the substrate;

e) placing spaced apart filter components on the particulate coated substrate; and f) folding the particulate coated substrate around the filter components.

9. A process as in claim 8 wherein the step of applying the electrostatic charge is variable whereby the thickness of the layer of particulate material is variable depending upon the strength of the electrostatic charge on the substrate.

10. A process as in claim 8 wherein the spaced apart filter components placed on the particulate coated substrate comprise cellulose acetate plugs.

11. A process as in claim 8 wherein the particulate material is selected from the group consisting of adsorbents, catalysts and flavorants.

12. A process as in claim 8 wherein the particulate material is an adsorbent selected from the group consisting of carbon, zeolite and APS silica gel.

13. A cigarette filter produced by the process of claim 1.

14. A cigarette filter produced by the process of claim 8.

15. A process for producing cigarette filters comprising the steps of:

a) conveying a continuous thin flexible filter paper substrate past a source of smoke altering particulate material;

b) applying an electrostatic charge onto the substrate upstream of the source of particulate material;

c) depositing a layer of particulate material from the source onto the substrate;

d) fusing or pressing the particulate material onto the substrate;

e) placing spaced apart filter components on the particulate coated substrate;

f) wrapping the particulate coated substrate around the spaced apart filter components along an axis parallel to the direction of substrate conveyance; and g) cutting the rolled particulate coated substrate and spaced apart filter arrangement into individual cigarette filter assemblies.

16. A process for producing cigarette filters comprising the steps of:

a) applying an electrostatic charge to a rotating transfer roll and depositing a smoke altering particulate material on the charged surface of the transfer roll;

b) conveying a continuous thin flexible substrate past the rotating transfer roll;

c) transferring the particulate material from the transfer roll onto the substrate by suction;

d) fusing or pressing the particulate material onto the substrate;

e) cutting the particulate coated substrate into pieces; and f) placing the pieces into cavities between spaced apart filter components.

17. A process as in claim 16 wherein the step of applying the electrostatic charge is variable whereby the thickness of the layer of particulate material is variable depending upon the strength of the electrostatic charge on the substrate.

18. A process as in claim 16 wherein the continuous substrate is filter paper.

19. A process as in claim 16 wherein the spaced apart filter components placed on the particulate coated substrate comprise cellulose acetate plugs.

20. A process as in claim 16 wherein the particulate material is selected from the group consisting of adsorbents, catalysts and flavorants.

21. A process as in claim 16 wherein the particulate material is an adsorbent selected from the group consisting of carbon, zeolite and APS silica gel.

22. A process as in claim 16 including the further step of:

g) rolling the particulate coated substrate into a cylindrical form along an axis transverse to the direction of substrate conveyance wherein the rolling occurs prior to the steps of cutting the particulate coated substrate into pieces and placement of the pieces into a position between spaced apart filter components.

23. A process as in claim 16 wherein the steps of cutting and placing are replaced by the steps of:

e) placing spaced apart filter components on the particulate coated substrate;

f) rolling the particulate coated substrate around the spaced apart filter components along an axis parallel to the direction of substrate conveyance; and g) cutting the rolled particulate coated substrate and spaced apart filter components into individual cigarette filter assemblies.

* * * * *